US011383263B2

(12) United States Patent
Zhou et al.

(10) Patent No.: US 11,383,263 B2
(45) Date of Patent: Jul. 12, 2022

(54) COATING DEVICE

(71) Applicants: HEFEI XINSHENG OPTOELECTRONICS TECHNOLOGY CO., LTD., Anhui (CN); BOE TECHNOLOGY GROUP CO., LTD., Beijing (CN)

(72) Inventors: Feiji Zhou, Beijing (CN); Haitao Long, Beijing (CN); Haitao Bai, Beijing (CN); Lu Cheng, Beijing (CN); Lingling Ge, Beijing (CN); Xiaoya Lu, Beijing (CN); Lu Xu, Beijing (CN); Xiaodong Yang, Beijing (CN); Kai Zhu, Beijing (CN); Chenchen Xiao, Beijing (CN); Wenxi Zhu, Beijing (CN); Jun Dai, Beijing (CN); Wei Zhou, Beijing (CN)

(73) Assignees: HEFEI XINSHENG OPTOELECTRONICS TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 726 days.

(21) Appl. No.: 16/329,115

(22) PCT Filed: Jun. 28, 2018

(86) PCT No.: PCT/CN2018/093444
§ 371 (c)(1),
(2) Date: Feb. 27, 2019

(87) PCT Pub. No.: WO2019/047600
PCT Pub. Date: Mar. 14, 2019

(65) Prior Publication Data

US 2021/0379619 A1 Dec. 9, 2021

(30) Foreign Application Priority Data

Sep. 11, 2017 (CN) ..... 201710813615.X

(51) Int. Cl.
*B05C 5/02* (2006.01)
*B05C 11/10* (2006.01)
(Continued)

(52) U.S. Cl.
CPC ..... *B05C 5/02* (2013.01); *B05B 15/52* (2018.02); *B05B 15/55* (2018.02);
(Continued)

(58) Field of Classification Search
CPC ..... B05C 5/02; B05C 5/0225; B05C 11/1026; B05C 11/11; B05C 11/1044; B05C 5/027;
(Continued)

(56) References Cited

U.S. PATENT DOCUMENTS 4,784,295 A * 11/1988 Holmstrand ..... B05B 9/04 222/148

FOREIGN PATENT DOCUMENTS

CN 101039758 A 9/2007
CN 203084376 U 7/2013
(Continued)

OTHER PUBLICATIONS

PCT International Search Report, Application No. PCT/CN2018/093444, dated Oct. 19, 2018, 8 pages: with English translation.
(Continued)

*Primary Examiner* — Laura Edwards
(74) *Attorney, Agent, or Firm* — Armstrong Teasdale LLP

(57) ABSTRACT

The present disclosure provides a coating device including a first storage tank for storing a material to be coated, a needle cannula to which the first storage tank is connected by means of a corresponding first line, a gas output device
(Continued)

for outputting a first pressurized gas from a gas source, including a first gas output line extending into the first storage tank, wherein the gas output device is capable of outputting the first pressurized gas to the first storage tank through the first gas output line such that the material to be coated stored in the first storage tank is discharged under a gas pressure and enters the needle cannula through the first line.

19 Claims, 5 Drawing Sheets

(51) Int. Cl.
*B05C 11/11* (2006.01)
*B05B 15/52* (2018.01)
*B05B 15/55* (2018.01)

(52) U.S. Cl.
CPC ..... *B05C 11/1013* (2013.01); *B05C 11/1026* (2013.01); *B05C 11/1044* (2013.01); *B05C 11/11* (2013.01); *B05C 5/027* (2013.01)

(58) Field of Classification Search
CPC ..... B05C 11/1013; G02F 1/1309; G02F 1/13; B05B 9/04; B05B 15/52; B05B 15/55
USPC ..... 118/300, 302
See application file for complete search history.

(56) References Cited

FOREIGN PATENT DOCUMENTS

| | | | |
|---|---|---|---|
| CN | 203133433 | U | 8/2013 |
| CN | 103934133 | A | 7/2014 |
| CN | 204429545 | U | 7/2015 |
| CN | 205334053 | U | 6/2016 |
| CN | 105750115 | A | 7/2016 |
| CN | 106526912 | A | 3/2017 |
| CN | 107520099 | A | 12/2017 |
| KR | 20010076833 | A | 8/2001 |
| KR | 20050030411 | A | 3/2005 |
| KR | 20160013708 | A | 2/2016 |

OTHER PUBLICATIONS

PCT Written Opinion, Application No. PCT/CN2018/093444, dated Oct. 19, 2018, 6 pages.: with English translation of relevant part.
China First Office Action, Application No. 201710813615.X, dated Nov. 26, 2018, 10 pps.: with English translation.
China Second Office Action, Application No. 201710813615.X, dated Jun. 4, 2019, 13 pps.: with English translation.

* cited by examiner

COATING DEVICE

CROSS REFERENCE TO RELATED APPLICATIONS

This patent application is a National Stage Entry of PCT/CN2018/093444 filed on Jun. 28, 2018, which claims the benefit and priority of Chinese Patent Application No. 201710813615.X filed on Sep. 11, 2017, the disclosures of which are incorporated by reference herein in their entirety as part of the present application.

BACKGROUND

The present disclosure relates to the technical field of product manufacturing and in particular to a coating device.

Coating of a material is often used in a manufacturing process of different products. For example, in the process of manufacturing a liquid crystal display, the color film substrate may suffer from the defect in discontinuous color film material layer, so it is necessary to use an ink needle to coat an ink material on the color film substrate for repair.

For this, a highly reliable ink coating device is needed.

BRIEF DESCRIPTION

The embodiments of the present disclosure provide a coating device including a first storage tank for storing a material to be coated, a needle cannula to which the first storage tank is connected by means of a corresponding first line, and a gas output device for outputting a first pressurized gas from a gas source, the gas output device including a first gas output line extending into the first storage tank, wherein the gas output device is capable of outputting the first pressurized gas to the first storage tank through the first gas output line such that the material to be coated stored in the first storage tank enters into the needle cannula through the first line.

The coating device may further include a second storage tank for storing a cleaning material, the second storage tank being connected to the first line through a second line, wherein the gas output device may further include a second gas output line extending into the second storage tank, the gas output device being capable of outputting gas to the second storage tank through the second gas output line such that the cleaning material in the second storage tank enters the first storage tank through the second line and the first line.

The number of the needle cannulas and the number of the first storage tanks may be equal and at least two in each case, and each of the needle cannulas may be connected to a corresponding one first storage tank through one first line respectively. The first line may be provided with a first multi-way reversing valve to which each of the gas source and the second storage tank is connected, wherein the first line may be in communication with the gas source, the second storage tank or the needle cannula by means of the first multi-way reversing valve.

Besides, the number of the needle cannulas may be at least two and each needle cannula may be connected to a corresponding first multi-way reversing valve. The number of the first storage tanks may be at least two and greater than the number of the needle cannulas. Each of the needle cannulas may be in communication with each of the first storage tanks through the first multi-way reversing valve and the first line. Each of the gas source and the second storage tank may be connected to each of the first multi-way reversing valves, wherein each of the first lines is in communication with the gas source or the second storage tank by means of the first multi-way reversing valve.

Different types of materials to be coated may be stored in different first storage tanks.

A second multi-way reversing valve may be disposed on the second line, upstream of the first multi-way reversing valve. The first line may be connected to the second storage tank by means of the first multi-way reversing valve, the second multi-way reversing valve and the second line sequentially.

The gas output device may further include a third gas output line, by means of which the first line may be connected to the gas source.

A third multi-way reversing valve may be disposed on the third gas output line, upstream of the first multi-way reversing valve, and the first line may be connected to the gas source by means of the first multi-way reversing valve, the third multi-way reversing valve, and the third gas output line sequentially.

The first gas output line may include a plurality of branch lines, each extending into one of the first storage tanks.

The coating device may further include a needle tip cleaning means which may be provided with a needle tip receiving groove.

The needle tip cleaning means may include a first body including a first end surface with a first slot, and a second body including a second end surface with a second slot, wherein the second body is connected to the first body by a pivot by means of which the second body is switchable between a first state in which the second end surface abuts against the first end surface, and the first slot and the second slot are combined to form the needle tip receiving groove, and a second state in which the second end surface is separated from the first end surface.

The needle cannula may include a connecting end formed with a central passage, and the first line may be provided with a line connector. The needle cannula may be connected with the first line by arranging the connecting end inside the line connector in a pluggable manner.

The connecting end may be provided with a circumferential slot, and at least two balls are arranged inside the line connector, wherein the balls may be clamped inside the slot when the connecting end is plugged inside the line connector.

The line connector may include a first cylinder having an inner wall surface, on which the balls are arranged circumferentially, and a first spring disposed inside the first cylinder and a positioner fixedly connected thereto, the positioner being provided with a central aperture, wherein when the connecting end is plugged inside the line connector, the connecting end may be aligned and connected with the positioner, and the central aperture may be in communication with the central passage of the connecting end.

The line connector may further include a second cylinder, sleeved on the first cylinder, and including a first portion that is fitted with the first cylinder and a second portion that is separated from the first cylinder to form a first mounting space, and a third portion forming a second mounting space, and a second spring sleeved on the first cylinder and disposed between the first cylinder and the second cylinder, with one part disposed in the first mounting space and the other part disposed in the second mounting space, wherein the second cylinder is movable in an axial direction relative to the first cylinder, and with the movement of the second cylinder relative to the first cylinder in the axial direction, a first portion of the first cylinder has a first state in which it abuts against the balls of the first cylinder and a second state in which it is separated from the balls.

The coating device may further include a holding seat and a holding block for holding the needle cannula, and a part of the needle cannula may be disposed inside the holding block and connected therewith integrally. The holding block may be disposed on the holding seat and may be in cooperative connection with the holding seat by means of detachably connected mating features arranged on the holding block and the holding seat respectively.

The detachably connected mating features may include a protrusion and a recess provided respectively on cooperating end surfaces of the holding block and the holding seat.

The holding block and the needle cannula may be made of plastic materials.

DETAILED DESCRIPTION

When an ink needle is used for repairing a color filter substrate, generally, an ink material for repairing is directly injected into a needle cannula of the ink needle, and the ink is discharged by manually applying a pressure to the needle cannula. If the ink needle is made of a glass material, the needle becomes prone to breakage due to excessive length for storing the ink material, and also is inconvenient to operate.

Because of manual application of the pressure to extrude the ink, it is necessary to reset a pressure value for extrusion according to experience whenever a defect is to be repaired. In the case of inaccurate pressure setting, it is necessary to set repeatedly and pre-coat, and a desired repair on the color film substrate can be performed only after a coating size is determined, which is quite time-consuming.

In addition, since it is difficult to control the pressure during the extrusion process of the ink, the needle cannula is susceptible to blockage during the repair process. Even if it is cleaned every day, this problem cannot be fundamentally solved.

For this, the present disclosure provides a coating device, capable of solving at least one of the aforementioned problems. The technical solution in the embodiments of the present disclosure will be illustrated clearly and completely below with reference to the drawings. Apparently, the embodiments illustrated herein are not exhaustive but only illustrative. Any other embodiments conceived by a skilled person in the art based on the present disclosure without inventive efforts shall be encompassed within the protection scope of the present disclosure.

Figure 1:
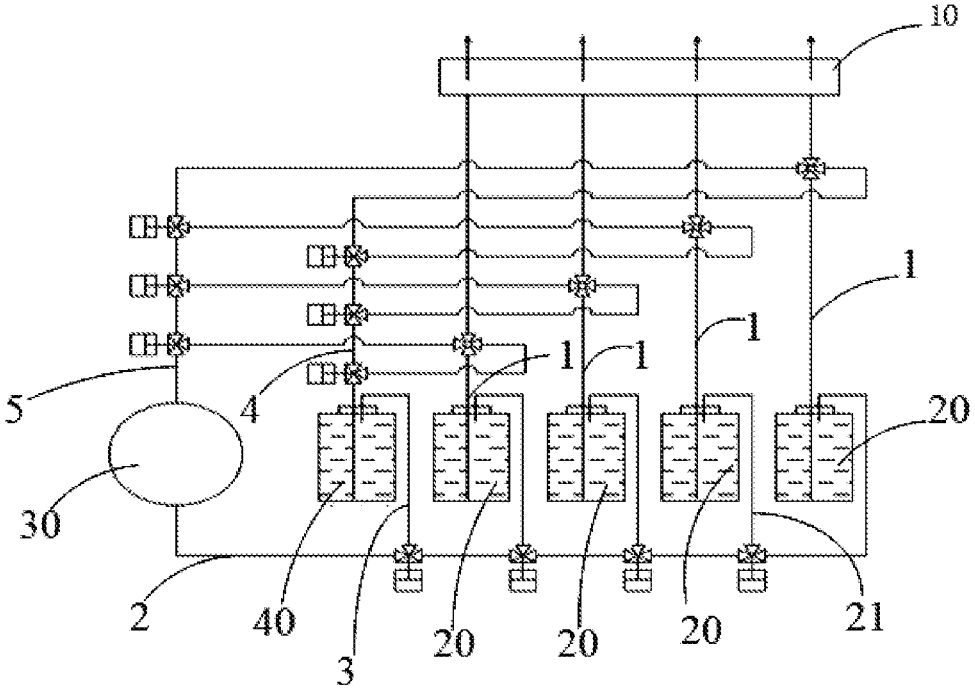
FIG. 1 is a view showing a first type of line connecting structure of the coating device according to an embodiment of the present disclosure.

FIG. 1 is a view showing a first type of line connecting structure of a coating device according to an embodiment of the present disclosure. Referring to FIG. 1, the coating device includes a holding seat 10 for holding needle cannula(s). The structure for arranging the needle cannula on the holding seat 10 is not shown in FIG. 1, with arrows to indicate the position of the needle cannula and a flow path of the ink material therein. According to FIG. 1, the coating device in this embodiment includes four needle cannulas.

In the embodiment of the present disclosure, the coating device further includes four first storage tanks 20 for storing different types of ink materials. Specifically, the four first storage tanks 20 may respectively store ink materials corresponding to a black matrix layer (BM), red color (R), green color (G), and blue color (B) on the color filter substrate, wherein the primary components of the ink materials are organic bromine compounds and various esters.

According to FIG. 1, in the embodiment of the present disclosure, each first storage tank 20 is connected to one needle cannula by means of a first line 1 in each case, and different first storage tanks 20 are connected to different needle cannulas by means of the first lines 1.

In the connecting structure of the embodiments in the present disclosure, the coating device further includes a gas output device 30 and a second storage tank 40. Specifically, the gas output device 30 may be an air compressor for outputting a predetermined pressurized gas. The second storage tank 40 is for storing a cleaning material, wherein the cleaning material is a material capable of cleaning the ink material in the first storage tank 20. A skilled person in the art should know the specific components of the cleaning material, which will not be described in detail herein.

Referring to FIG. 1, in the embodiments of the present disclosure, the gas output device 30 extends into the first storage tank 20 through a first gas output line 2, wherein the first gas output line 2 includes a plurality of branch lines 21, each extending into one of the first storage tanks 20, respectively, and extending into the second storage tank 40 through a second gas output line 3. Specifically, in the embodiments of the present disclosure, the first gas output line 2, the branch line 21 and the second gas output line 3 are connected by means of a three-way reversing valve to a gas output end of the gas output device 30. When the gas output device 30 is used to output gas into the first storage tank 20 or into the second storage tank 40, it is only necessary to switch the three-way reversing valve to a state of communicating with a corresponding line.

The second storage tank 40 is also connected to each of the first lines 1 through a second line 4, and the gas output device 30 is also connected to the first line 1 through a third gas output line 5. Referring to FIG. 1, in the embodiments of the present disclosure, each of the first lines 1 is provided with a four-way reversing valve in each case, and the second line 4 connected with the second storage tank 40 is provided with a plurality of three-way reversing valves. The connection between the second line 4 and the first line 1 is realized by interconnecting one of the four-way reversing valves on the first line 1 with one of the three-way reversing valves. Each of the four-way reversing valves has a state in which the first line 1 is in communication with the second line 4 and a state in which the communication therebetween is cut off, and when the first line 1 and the second line 4 is disconnected, the whole first line 1 itself is unblocked such that the ink material in the first storage tank 20 can be conveyed to the needle cannula. When it is required to communicate the second storage tank 40 with one of the first storage tanks 20 for cleaning the latter, the three-way reversing valve and the four-way reversing valve on the corresponding lines can be controlled to switch between different states so that the corresponding lines are in a communication state.

Besides, the third gas output line 5 connected to the gas output device 30 is provided with a plurality of three-way reversing valves, and the connection between the third gas outlet line 5 and the first line 1 is realized by connecting one of the three-way reversing valves on the third gas output line 5 with one of the four-way reversing valves on the first line 1. Each of the four-way reversing valves further has a state in which the first line 1 is in communication with the third gas output line 5 and a state in which the communication therebetween is cut off. When the gas output device 30 is required to output gas to one of the first lines 1 so as to dry the corresponding first line 1 and the needle cannula by blowing, it is possible to control the three-way reversing valve and the four-way reversing valve on the corresponding lines to switch their states, thereby allowing the corresponding lines in communication state.

In the first type of line connecting structure shown in FIG. 1, each needle cannula is connected to one of the first storage tanks 20 via one first line 1, and different needle cannulas are connected to different first storage tanks 20. When it is required to use one of the ink materials to repair the color film substrate, the four-way reversing valve on the first line 1, which line is connected to the first storage tank 20 storing the corresponding ink material, is controlled in such a state that the whole first line 1 itself is unblocked, and the corresponding branch line is connected to the gas output device. By virtue of the interconnected first gas output line 2 and the branch line 21, the gas output device 30 can output the gas into the corresponding first storage tank 20 such that the ink material in the corresponding first storage tank 20 is discharged under gas pressure, enters the needle cannula through the corresponding first line 1, and then flows out from a needle tip of the needle cannula for repairing the color film substrate.

Because the gas output device 30 is also connected to the first line 1 by means of the third gas output line 5, when the corresponding first line 1 and the third gas output line 5 are in communication by controlling the communication state of the four-way reversing valve on the first line 1 and the three-way reversing valve on the third gas output line 5, it is possible to output gas to the corresponding first line 1 from the gas output device 30, and to dry the first line and the needle cannula by blowing so as to prevent the ink material blocking the needle tip during the use of the needle cannula on the corresponding first line 1.

Further, when the ink material in one of the first storage tanks 20 has run out, the second line 4 is in communication with the first storage tank 20 by way of controlling the communication state of the four-way reversing valve on the first line 1, which line is connected to the first storage tank 1, and the three-way reversing valve on the second line 4, and the second storage tank 4 is in communication with the gas output device 3 through the second gas output line 3 so as to output gas into the second storage tank 40 such that the cleaning material in the second storage tank 40 is discharged under gas pressure and enters into the first storage tank 20 through the second line 4 and the first line 1 for cleaning the first storage tank 20 and preparing for refilling fresh ink material into the first storage tank 20.

Figure 2:
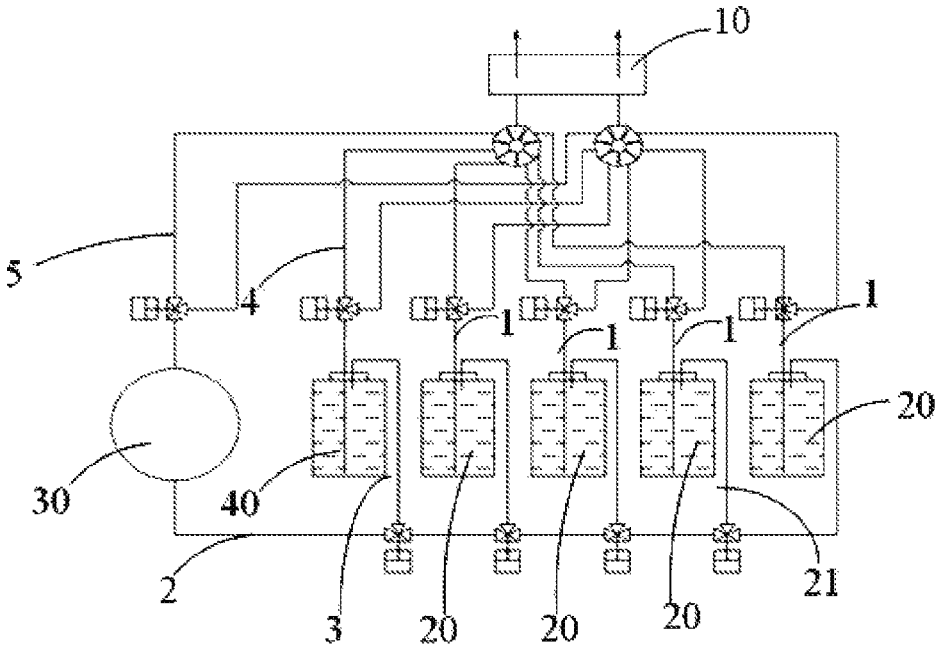
FIG. 2 is a schematic view showing a second type of line connecting structure of the coating device according to an embodiment of the present disclosure.

In addition, the coating device of the embodiments in the present disclosure further provides a second type of line connecting structure. As shown in FIG. 2, the coating device includes a holding seat 10 for holding needle cannulas. In the embodiments of the present disclosure, the coating device includes four needle cannulas.

Further, similar to the first type of line connecting structure, the coating device further includes four first storage tanks 20 for storing different types of ink materials. Specifically, the four first storage tanks 20 may respectively store ink materials corresponding to the black matrix layer (BM), red color (R), green color (G), and blue color (B) on the color filter substrate.

In the connecting structure of the embodiments in the present disclosure, each needle cannula is connected to one first storage tank 20 by means of the first line 1, and the first line 1 is provided with a seven-way reversing valve by means of which the needle cannula may be in communication with one of the first storage tanks 20. Specifically, according to FIG. 2, each first storage tank 20 is connected to one first line 1 in each case, and each first line 1 is connected to two seven-way reversing valves which are connected to a needle cannula respectively. The two seven-way reversing valves are capable of controlling the connected needle cannula in communication with one of the first lines 1 so that the ink material in the first storage tank 20 connected to the first line 1 can enter into the needle cannula for repairing the color film substrate.

In the connecting structure of the embodiments in the present disclosure, the coating device further includes a gas output device 30 and a second storage tank 40. Specifically, the gas output device 30 may be an air compressor for outputting gas with a predetermined pressure, and the second storage tank 40 is for storing a cleaning material.

Referring to FIG. 2, in the connecting structure of the embodiment in the present disclosure, the gas output device 30 extends into the first storage tank 20 through the first gas output line 2. The first gas output line 2 includes a plurality of branch lines 21 each extending into one of the first storage tanks 20, and further extending into the second storage tank 40 through the second gas output line 3. The first gas output line 2, the branch line 21, and the second gas output line 3 are connected to one another via a three-way reversing valve, and are connected to a gas output end of the gas output device 30 such that when the gas output device 3 is used to output gas into one of the first storage tanks 20 or into the second storage tank 40, it is only necessary to switch the corresponding three-way reversing valve to a state in which the corresponding lines are in communication.

The second storage tank 40 is also connected to each first line 1 via the second line 4, and the gas output device 30 is also connected to the first line 1 via the third gas output line 5. In the connecting structure of the embodiments in the present disclosure, the second line 4 and the third gas output line 5 are each provided with a three-way reversing valve, and are connected to each first line 1 and therefore to the two needle cannulas by means of the three-way reversing valves which are each connected to the two seven-way reversing valves.

According to the above, each seven-way reversing valve has a state in which one of the first lines 1 is in communication with the connected needle cannula, a state in which one of the first lines 1 is in communication with the second line 4, and a state in which the first line 1 is in communication with the third gas output line 5.

By virtue of the second type of line connecting structure shown in FIG. 2, two needle cannulas may be connected to each first storage tank 20, respectively. When one of the ink materials is required to repair the color film substrate, it is possible to control the seven-way reversing valve connected to one of the needle cannulas so as to switch its state such that the first line 1 connected to the first storage tank 20 storing the corresponding ink material is in communication with the corresponding needle cannula, and also to control the branch line corresponding to the first storage tank 20 storing the corresponding ink material to be connected to the gas output device 30. The gas output device 30 may output gas into the corresponding first storage tank 20 through the first gas output line 2 and the branch line 21 connected to each other, so that the ink material in the corresponding first storage tank 20 is discharged under the gas pressure, enters the needle cannula connected to the seven-way reversing valve through the corresponding first line 1 and then flows out from the needle tip of the needle cannula for repairing the color film substrate.

Since the gas output device 30 is also connected to each seven-way reversing valve via the third gas output line 5, during the process of controlling repair of the color film substrate, when the seven-way reversing valve connected to the other needle cannula different from the used one is switched to a state in which the third gas output line 5 is in communication with the line to which the other needle cannula is connected (that is, the third gas output line 5 is in communication with the other needle cannula), the gas can be output to the other needle cannula through the gas output device 30. Thereby one needle cannula can be dried by blowing while the other is in use. Therefore, by virtue of the second type of line connection, when one needle cannula is used to repair the color film substrate, the other may be subjected to drying to be ready for another ink material output from the needle cannula for the color film substrate repair. This saves time for repairing the color film substrate.

In addition, when the ink material in one of the first storage tanks 20 has run out, the first line 1 connected to the first storage tank 20 and the second line 4 connected to the second storage tank 40 are in communication by controlling the communication state of one of the seven-way reversing valves, and the second storage tank 40 is in communication with the gas out output device 30 by means of the second gas output line 3 to output gas into the second storage tank 40 such that the cleaning material in the storage tank 40 is discharged by the gas pressure, and enters the first storage tank 20 through the second line 4 and the first line 1 for cleaning the first storage tank 20 and preparing for refilling fresh ink material into the first storage tank 20.

When one needle cannula is used to repair the color film substrate with the ink material in one of the first storage tanks 20, another first storage tank 20 can be cleaned in the above manner, reference of which is made to the above description. The process will not be illustrated herein again.

Compared with the first type of line connecting structure, the second type of line connecting structure makes it possible to output different ink materials by using a needle cannula, and drying of another needle cannula or cleaning of another storage tank can be completed simultaneously while the color film substrate is repaired by using one of the needle cannulas and one of the first storage tanks.

In the coating device of the embodiments in the present disclosure, an ink material is supplied to the needle cannula by connecting the first storage tank for storing the ink material to the needle cannula for repairing the color filter substrate, which can reduce the length of the needle cannula and prevent breakage of the needle cannula caused by its excessive length.

Figure 3:
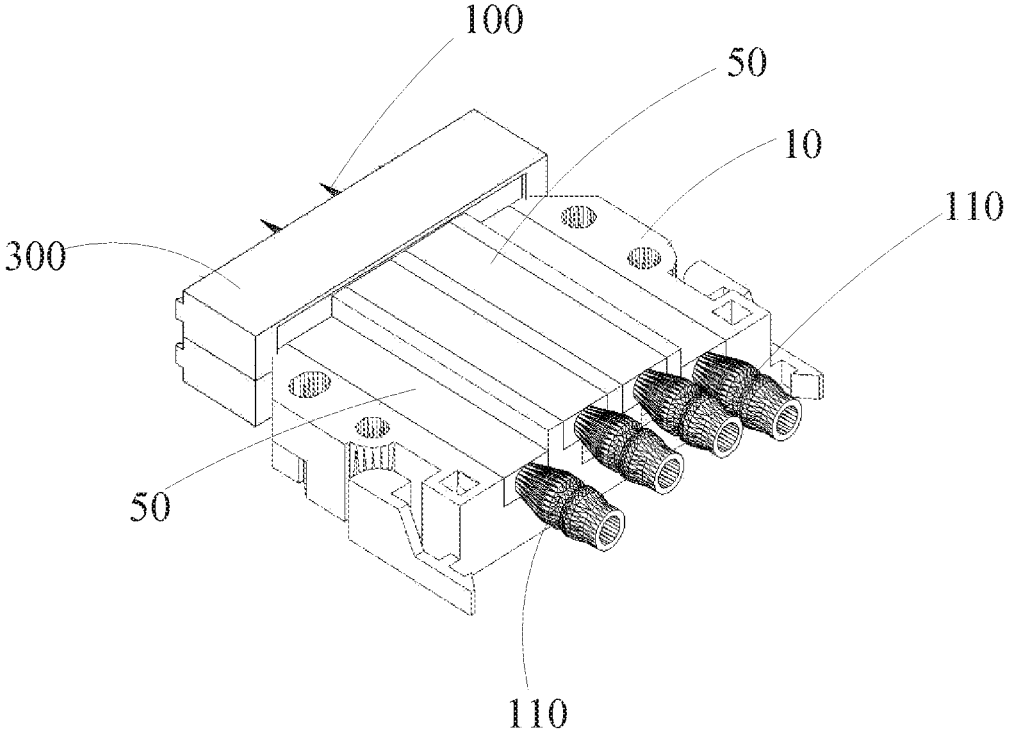
FIG. 3 is a schematic view showing a connecting structure of the needle cannulas of the coating device according to an embodiment of the present disclosure.
Figure 4:
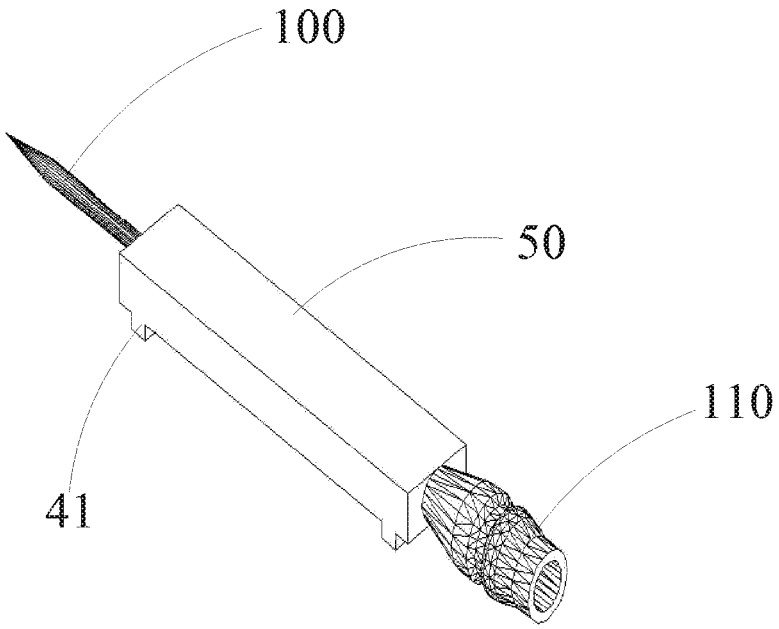
FIG. 4 is a schematic view of one of the needle cannulas of the coating device according to an embodiment of the present disclosure.

As shown in FIGS. 3 and 4, the coating device of the embodiment in the present disclosure may further include a holding block 50, a portion of the needle cannula 100 being positioned inside the holding block 50 and connected thereto integrally, wherein the holding block 50 is disposed on the holding seat 10 and in cooperative connection therewith.

In the coating device, the holding block 50 and the needle cannula 100 are made of plastic materials. Compared with the needle cannulas made of glass materials, the needle cannula 100 made of plastic materials is not easy to break. In addition, the holding block 50 and the holding seat 10 are respectively provided with a detachably connectable mating structure. For example, a protrusion 41 is provided on an end surface of the holding block 50, and a recess may be provided in an end surface of the holding seat 10 that may cooperate with the holding block 50 such that when the holding block 50 is arranged on the holding seat 10, the protrusion 41 on the holding block 50 is in cooperative connection with the recess in the holding seat 10. The detachable connection makes the assembling and disassembling of the needle cannula 100 simple and convenient. In addition, the holding block 50 also functions to buffer the needle cannula 100.

Figure 5:
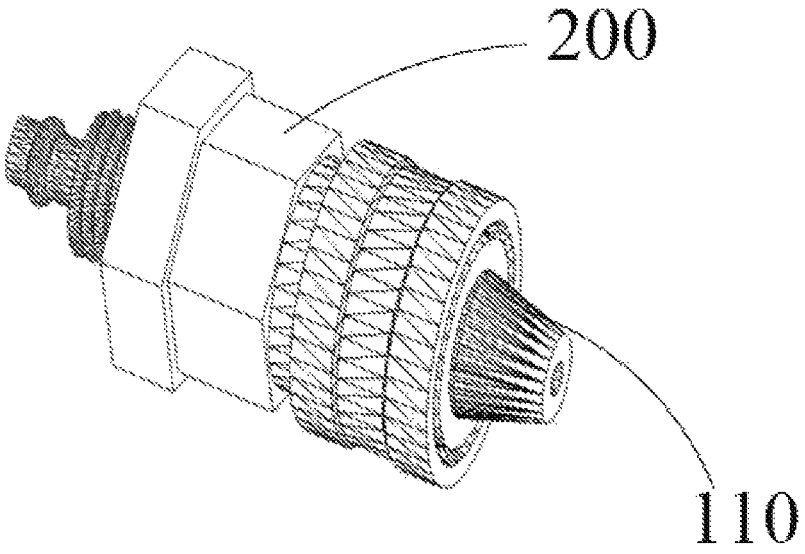
FIG. 5 is a schematic perspective view, showing the connecting end of the needle cannula assembled with the line connector of the coating device according to an embodiment of the present disclosure.
Figure 6:
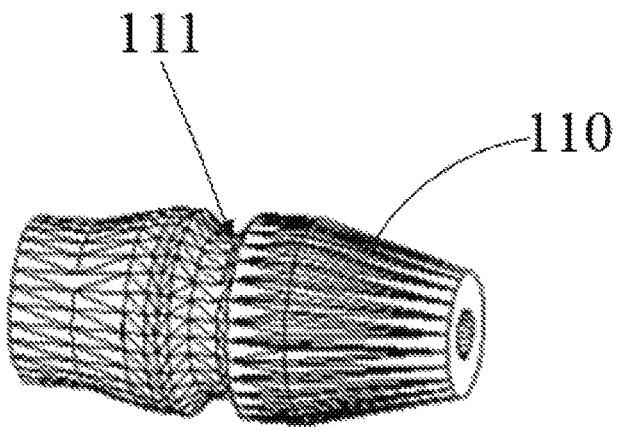
FIG. 6 is a perspective structural view of the connecting end of the needle cannula of the coating device according to an embodiment of the present disclosure.

Referring to FIGS. 3 and 4, each needle cannula 100 includes a connecting end 110 formed with a central passage, and the first line connected to the needle cannula 100 is provided with a line connector 200 (as shown in FIGS. 5 and 6). The needle cannula 100 is connected to the first line by arranging the connecting end 110 inside the line connector 200 in a pluggable manner.

Specifically, with reference to FIGS. 5 and 6, the connecting end 110 is provided with a circumferential slot 111. At least two balls are disposed inside the line connector 200, and the balls are clamped in the slot 111 when the connecting end 110 is inserted into the line connector 200.

Figure 7:
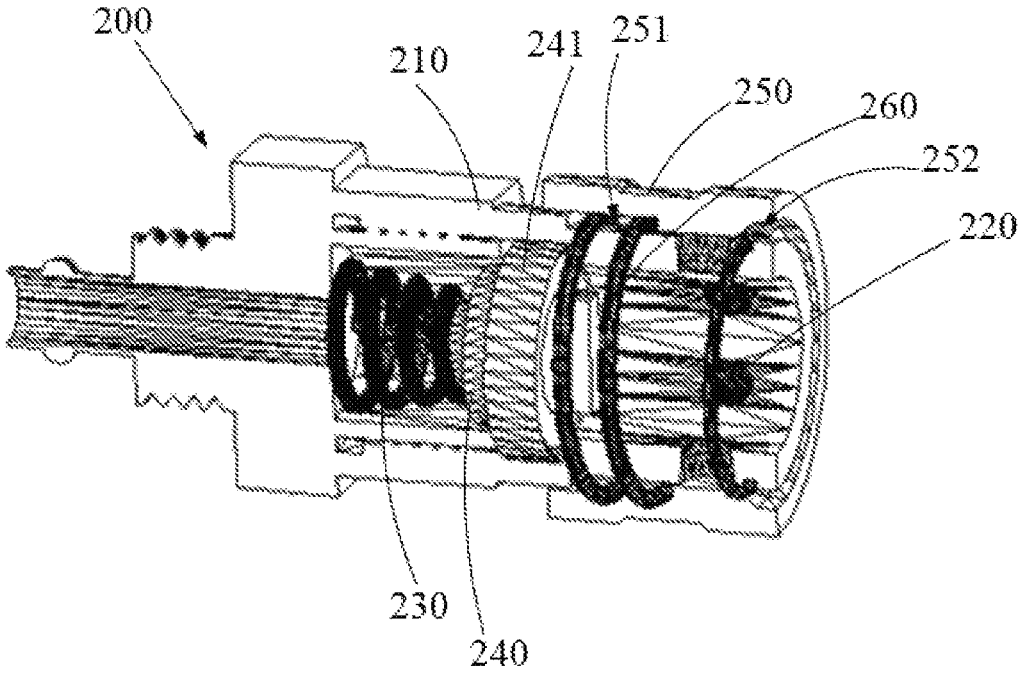
FIG. 7 is a first lengthwise sectional view of a line connector of the coating device according to an embodiment of the present disclosure.
Figure 8:
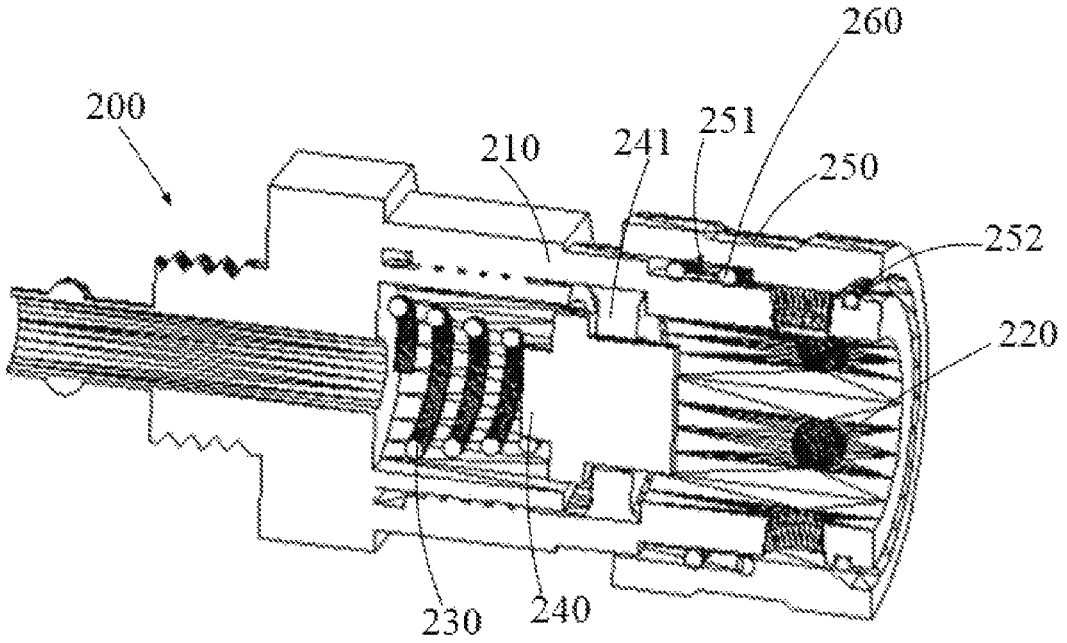
FIG. 8 is a second lengthwise sectional view of a line connector of the coating device according to an embodiment of the present disclosure.

Referring to FIGS. 7 and 8, the line connector 200 specifically includes a first cylinder 210 having an inner wall surface, on which the balls 220 are arranged circumferentially, and a first spring 230 disposed inside the first cylinder 210 and a positioner 240 fixedly connected thereto, wherein the positioner 240 is provided with a central aperture which has a central axis where the central axis of the first cylinder 210 is also located, wherein when the connecting end 110 is inserted into the line connector 200, the connecting end 110 is aligned with and connected to the positioner 240, and the central aperture of the positioner 240 and the connecting end 110 are in communication.

In addition, the line connector 200 further includes a second cylinder 250 sleeved onto the first cylinder 210, the second cylinder 250 including a first portion that is fitted with the first cylinder 210, a second portion that is separated from the first cylinder 210 to form a first mounting space 251, and a third portion forming a second mounting space 252, and a second spring 260 sleeved onto the first cylinder 210 and disposed between the first cylinder 210 and the second cylinder 250, with one part arranged in the first mounting space 251, and the other part arranged in the second mounting space 252.

The second cylinder 250 is movable in an axial direction relative to the first cylinder 210. With the movement of the second cylinder 250 relative to the first cylinder in the axial direction, the first portion of the first cylinder 210 has a first state in which it abuts against the balls 220 of the first cylinder 210 and a second state in which it is separated from the balls 220.

The balls 220 mounted on the first cylinder 210 is movable in a space upwards and downwards, that is, in a direction substantially perpendicular to the central axis of the first cylinder 210. The balls 220 have a diameter greater than the wall thickness of the first cylinder 210. There is less portion of the ball 220 that protrudes radially from the inner wall surface of the first cylinder 210 when the first portion of the second cylinder 250 does not abut against the ball 220. Then the connecting end of the first line 1 (see FIGS. 1 and 2) can be smoothly inserted into the first cylinder 210. When the first portion of the second cylinder 250 is pressed against the ball 220, the ball 220 that protrudes radially from the inner wall surface of the first cylinder 210 becomes greater. In this case, if the connecting end 110 has been inserted into the first cylinder 210 and the position of the slot 111 corresponds to that of the balls 220, the balls 220 can be clamped into the slot 111 so as to fix the connecting end 110 in the line connector 200.

With respect to the connection between the connecting end 110 and the line connector 200, the first spring 230 is used to provide an axial force for the positioner 240 that moves it along the central axis direction of the first cylinder 210, thereby ensuring accurate positioning and fitted connection of the positioner 240 and the connecting end 110. The second spring 260 is used to provide an axial force for the second cylinder 250 that moves it along the central axis direction of the first cylinder 210, so that the second cylinder 250 is switched between the first state and the second state.

When the connecting end 110 is mounted and dismounted relative to the line connector 200, only the second cylinder 250 needs to be dragged such that the second cylinder 250 moves relative to the first cylinder 210 in a direction opposite to the insertion direction of the connecting end 110, and is switched from a first state to a second state. The connecting end 110 can therefore be smoothly inserted into or extracted from the first cylinder 210. Then the force for dragging the second cylinder 250 may be cancelled, and under an elastic reset force of the second spring 260, the second cylinder 250 returns to the first state to accomplish the insertion or extraction process of the connecting end 110. Therefore, this process can be implemented simply and conveniently. In addition, the cooperation of the balls and the slot of the connecting end 110 and the line connector 200 can ensure a relative rotation of the connecting end 110 with respect to the line connector 200 after connection.

Further, according to FIGS. 7 and 8, the positioner 240 is provided with a seal 241. An outer surface of the seal 241 abuts against the inner wall surface of the first cylinder 210 to ensure sealing between the connecting end 110 and the positioner 240 during convey of the ink materials.

Figure 9:
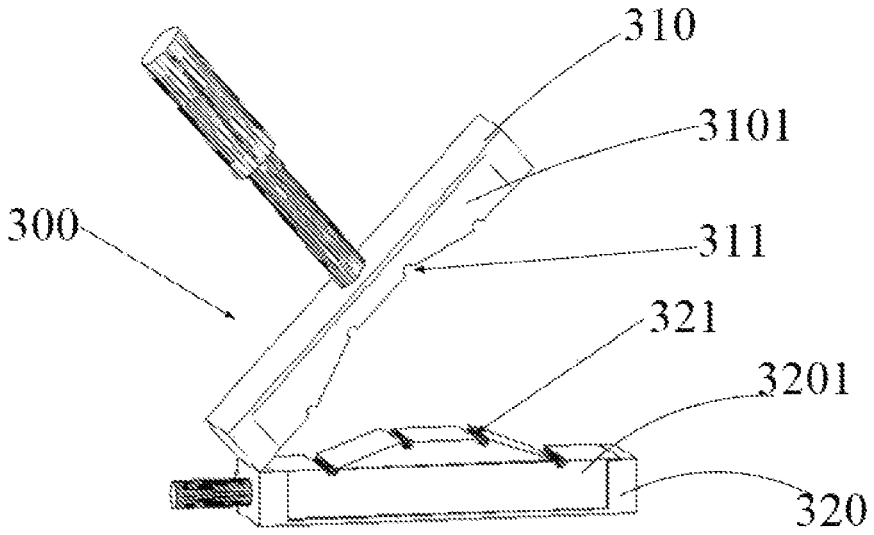
FIG. 9 is a schematic view of the cleaning means of the coating device according to an embodiment of the present disclosure.

In the coating device according to the embodiments of the present disclosure, as shown in FIGS. 3 and 9, the coating device further includes a needle tip cleaning means 300, which in use is disposed on a side of the holding seat 10 where the needle tip of the needle cannula 100 is exposed. The needle tip cleaning means 300 is provided with a needle tip receiving groove for insertion of the needle tip of the needle cannula 100. The number of the needle tip receiving grooves is the same as that of the needle cannulas 100, each needle tip receiving groove for insertion of one needle tip of the needle cannula 100.

Specifically, the needle tip cleaning means 300 includes a first body 310 including a first end surface with a first slot 311, and a second body 320 including a second end surface with a second slot 321, wherein the second body 320 is connected to the first body 310 via a pivot, and is switchable by the pivot between a first state in which the second end surface and the first end surface abut against each other and the first slot 311 and the second slot 322 are combined to form a needle tip receiving groove, and a second state in which the second end surface is separated from the first end surface.

In addition, the first body 310 includes a first base and a first inner core 3101 made of a rubber material, wherein the first slot 311 is arranged in the first inner core. The second body 320 includes a second base and a second inner core 3201 made of a rubber material, wherein the second slot 321 is arranged in the second inner core 3201. Moreover, the first inner core and the second inner core made of rubber materials are detachably connected to the first base and the second base respectively for convenient replacement.

When the needle tip cleaning means 300 is in use, the first body 310 may be in an open state relative to the second body 320, and the needle tip exposed from the holding seat 10 is moved into the second slot 321 of the second body 320, and then the first body 310 is closed relative to the second body 320 such that the entire needle tip is inserted into the needle tip receiving groove formed by the needle tip cleaning means 300. Thereafter, the entire holding seat 10 is moved relative to the needle tip cleaning means 300 away therefrom, so that the needle tip is cleaned by its movement relative to the needle tip receiving groove. Of course, after the entire needle tip is inserted into the needle tip receiving groove formed by the needle tip cleaning means 300, the holding seat 10 may be stationary and the needle tip cleaning means 300 is movable toward and away from the holding seat 10 to clean the needle tip.

In the embodiment of the present disclosure, the coating device further includes a receptacle disposed below the needle tip cleaning means 300 for receiving materials that fall when the needle tip being cleaned.

In the coating device of the embodiments in the present disclosure, compared with storage of the ink material with the needle cannula, by connecting the first storage tank for storing the ink materials to the needle cannula and by using the gas output device to apply gas pressure to the ink materials in the first storage tank, a constant pressure can be ensured during the repair process, and the pressurizing process can be subjected to automatic controlling, thereby solving the problem in long repair time and easy blockage of the needle tip caused by manual control of the pressure for extruding the ink materials when ink is used to repair the color filter substrate.

Due to the coating device of the present disclosure, the pressure during the repair process is constant, and excessively large or small ink coating area can be prevented. Furthermore it is not necessary to pre-coat before each repair. Instead, the repair operation can be directly carried out, thereby saving the repair time and enhancing the efficiency of repair.

In the coating device of the embodiments in the present disclosure, it is possible to clean the first storage tank when the ink material therein has run out by providing the second storage tank for storing the cleaning material and by connecting the second line with the first line of the first storage tank. Also, it is possible to communicate the gas output device with the first line by providing the third gas output line, and to dry the first line and the needle cannula by blowing. The arrangements of these components and the connection of the lines enable automatic cleaning and drying of different parts to avoid blocking.

The above is particular embodiments of the present disclosure. It should be noted that various improvements and modifications can be made by a skilled person in the art without departing from the principles of the present disclosure, which improvements and modifications shall be encompassed within the protection scope of the present disclosure.

What is claimed is:

1. A coating device comprising:

a first storage tank for storing a material to be coated;

a needle cannula connected to the first storage tank using a corresponding first line;

a gas output device for outputting a first pressurized gas from a gas source, the gas output device comprising a first gas output line extending into the first storage tank, wherein the gas output device is capable of outputting the first pressurized gas to the first storage tank through the first gas output line such that the material to be coated stored in the first storage tank enters the needle cannula through the first line; and a second storage tank for storing a cleaning material, the second storage tank connected to the first line through a second line, wherein the gas output device further comprises a second gas output line extending into the second storage tank, the gas output device capable of outputting gas to the second storage tank through the second gas output line such that the cleaning material in the second storage tank enters the first storage tank through the second line and the first line.

2. The coating device according to claim 1, wherein a number of needle cannulas and a number of first storage tanks are equal and at least two in each case, wherein each of the needle cannulas is connected to a corresponding one first storage tank through one first line respectively, wherein the first line is provided with a first multi-way reversing valve to which each of the gas source and the second storage tank is connected, and wherein the first line is in communication with at least one of the gas source, the second storage tank, and the needle cannula using the first multi-way reversing valve.

3. The coating device according to claim 1, wherein a number of needle cannulas is at least two and each needle cannula is connected to a corresponding first multi-way reversing valve, wherein a number of first storage tanks is at least two and greater than the number of needle cannulas, with each of the needle cannulas capable of being in communication with each of the first storage tanks through the first multi-way reversing valve and a corresponding first line, wherein each of the gas source and the second storage tank is connected to each of the first multi-way reversing valves, and wherein each first line is capable of being in communication with the gas source or the second storage tank using the first multi-way reversing valve.

4. The coating device according to claim 2, wherein different materials to be coated are stored in different first storage tanks.

5. The coating device according to claim 2, wherein a second multi-way reversing valve is disposed on the second line, upstream of the first multi-way reversing valve, and wherein the first line is connected to the second storage tank using the first multi-way reversing valve, the second multi-way reversing valve, and the second line sequentially.

6. The coating device according to claim 2, wherein the gas output device further comprises a third gas output line that connects the first line to the gas source.

7. The coating device according to claim 6, wherein a third multi-way reversing valve is disposed on the third gas output line, upstream of the first multi-way reversing valve, and wherein the first line is connected to the gas source using the first multi-way reversing valve, the third multi-way reversing valve, and the third gas output line sequentially.

8. The coating device according to claim 1, wherein the first gas output line comprises a branch line extending into the first storage tank.

9. The coating device according to claim 1, further comprising a needle tip cleaning means provided with a needle tip receiving groove.

10. The coating device according to claim 9, wherein the needle tip cleaning means comprises:

a first body including a first end surface with a first slot; and a second body including a second end surface with a second slot, wherein the second body is connected to the first body by a pivot that enables the second body to be switchable between i) a first state in which the second end surface abuts against the first end surface, and wherein the first slot and the second slot are combined to form the needle tip receiving groove, and ii) a second state in which the second end surface is separated from the first end surface.

11. The coating device according to claim 1, wherein the needle cannula comprises a connecting end formed with a central passage, wherein the first line is provided with a line connector, and wherein the needle cannula is connected with the first line by arranging the connecting end inside the line connector in a pluggable manner.

12. The coating device according to claim 11, wherein the connecting end is provided with a circumferential slot, wherein at least two balls are arranged inside the line connector, and wherein the balls are clamped inside the slot when the connecting end is plugged inside the line connector.

13. The coating device according to claim 12, wherein the line connector comprises:

a first cylinder having an inner wall surface on which the balls are arranged circumferentially; and a first spring disposed inside the first cylinder and a positioner fixedly connected thereto, the positioner provided with a central aperture, wherein when the connecting end is plugged inside the line connector, the connecting end is aligned and connected with the positioner, and wherein the central aperture is in communication with the central passage of the connecting end.

14. The coating device according to claim 13, wherein the line connector further comprises:

a second cylinder, sleeved on the first cylinder, and including a first portion that is fitted with the first cylinder and a second portion that is separated from the first cylinder to form a first mounting space and a third portion forming a second mounting space; and a second spring sleeved on the first cylinder and disposed between the first cylinder and the second cylinder, with one part of the second spring disposed in the first mounting space and another part disposed in the second mounting space, wherein the second cylinder is movable in an axial direction relative to the first cylinder, and with movement of the second cylinder relative to the first cylinder in the axial direction, a first portion of the first cylinder has a first state in which it abuts against the balls of the first cylinder and a second state in which it is separated from the balls.

15. The coating device according to claim 1, further comprising a holding seat and a holding block for holding the needle cannula, wherein a part of the needle cannula is disposed inside the holding block and connected therewith integrally, and wherein the holding block is disposed on the holding seat and in cooperative connection with the holding seat using detachably connected mating features arranged on the holding block and the holding seat respectively.

16. The coating device according to claim 15, wherein the detachably connected mating features comprise a protrusion and a recess provided respectively on cooperating end surfaces of the holding block and the holding seat.

17. The coating device according to claim 15, wherein the holding block and the needle cannula are made of plastic materials.

18. The coating device according to claim 3, wherein a second multi-way reversing valve is disposed on the second line, upstream of the first multi-way reversing valve, and wherein the first line is connected to the second storage tank using the first multi-way reversing valve, the second multi-way reversing valve, and the second line sequentially.

19. The coating device according to claim 3, wherein the gas output device further comprises a third gas output line that connects the first line to the gas source.

* * * * *